US007100763B2

(12) United States Patent
Draghetti

(10) Patent No.: US 7,100,763 B2
(45) Date of Patent: Sep. 5, 2006

(54) RIGID PACK WITH A HINGED LID

(75) Inventor: Fiorenzo Draghetti, Medicina (IT)

(73) Assignee: G.D S.p.A., Bologna (IT)

( * ) Notice: Subject to any disclaimer, the term of this patent is extended or adjusted under 35 U.S.C. 154(b) by 67 days.

(21) Appl. No.: 10/482,189

(22) PCT Filed: Oct. 29, 2002

(86) PCT No.: PCT/IB02/04529

§ 371 (c)(1),
(2), (4) Date: Dec. 30, 2003

(87) PCT Pub. No.: WO03/039998

PCT Pub. Date: May 15, 2003

(65) Prior Publication Data

US 2004/0178089 A1 Sep. 16, 2004

(30) Foreign Application Priority Data

Nov. 5, 2001 (IT) ..... BO2001A0669

(51) Int. Cl.
*B65D 85/10* (2006.01)

(52) U.S. Cl. ..... 206/268; 206/273; 229/160.1

(58) Field of Classification Search ..... 206/242, 206/265, 268, 271, 273; 229/146, 160.1
See application file for complete search history.

(56) References Cited

U.S. PATENT DOCUMENTS

| | | | | |
|---|---|---|---|---|
| 5,341,925 | A | 8/1994 | Fleenor et al. | |
| 5,366,077 | A | 11/1994 | Pham | |
| 5,630,508 | A * | 5/1997 | Petit | 206/387.1 |
| 5,806,671 | A | 9/1998 | Focke et al. | |
| 5,904,244 | A | 5/1999 | Focke et al. | |

FOREIGN PATENT DOCUMENTS

| | | |
|---|---|---|
| EP | 1000876 | 5/2000 |
| WO | 0144077 | 6/2001 |

OTHER PUBLICATIONS

International Search Report dated Jan. 30, 2003.

* cited by examiner

*Primary Examiner*—Mickey Yu
*Assistant Examiner*—Jerrold Johnson
(74) *Attorney, Agent, or Firm*—Timothy J. Klima

(57) ABSTRACT

A rigid hinged-lid packet for tobacco products appears as container (3) with an open end (4), and a lid (5) hinged to the container (3) so as to rotate between positions in which the open end (4) is open and closed, also a stiffening frame (15) projecting from the open end (4) and presenting two side pieces (19) destined to enter into contact with the insides of two respective flank faces (13) of the lid (5) when the packet is closed. To retain the lid (5) more firmly in the closed position, the inside of each flank face (13) is fashioned with a freely projecting tongue (52) bent inwards in such a manner that when the lid (5) is returned to the closed position, the tongue (52) will locate in an opening (55) afforded by a slit (54) formed in the corresponding side piece (19) of the frame (15).

13 Claims, 5 Drawing Sheets

RIGID PACK WITH A HINGED LID

This application is the National Phase of International Application PCT/IB02/04529 filed Oct. 29, 2002 which designated the U.S. and that International Application was published under PCT Article 21(2) in English.

TECHNICAL FIELD

The present invention relates to a rigid packet with hinged lid for tobacco products.

BACKGROUND ART

In particular, the invention relates to a hinge-lid type cigarette packet of the type comprising a cupped container that presents a front face and a rear face, mutually opposed and parallel, two flank faces disposed mutually parallel and perpendicular to the front and rear faces, a bottom end face perpendicular to the front, rear and flank faces, and an open top end. The packet also comprises a lid, likewise of cupped embodiment, hinged to the container along an edge of the aforementioned rear face that coincides with a top edge of the open end. The lid is rotatable thus about the hinge toward and away from a position in which the open top end of the container is concealed, and presents a front face and a rear face, mutually opposed and parallel, two flank faces mutually parallel and perpendicular to the front and rear faces, also a face disposed perpendicular to the front, rear and flank faces and constituting the top end face of the packet.

The packet also comprises a stiffening frame bent to assume a U profile, located internally of the container in part and disposed in contact with the inside of the front face and the flank faces of the selfsame container, which presents a breast piece, and two side pieces joined to the breast piece along respective corner edges. Both the breast piece and the side pieces project upward from the open top end of the container to engage the lid in part.

The main function of the frame in rigid packets of the type described above, generally considered, is to ensure a degree of interference with the lid such as will reduce the likelihood of the selfsame lid being opened accidentally.

In order to maximize this interference and thus maintain the hinged lid as stably as possible in the closed position, the prior art embraces the expedient of cutting C-shaped slits in the corner edges of the frame, each generating a respective tab that projects toward and engages the inside of the relative flank face of the lid when the lid occupies the closed position, thereby increasing the degree of interference.

This method of retaining the hinged lid in the closed position has been found effective enough in the case of conventional rigid packets typified by a parallelepiped geometry with sharp longitudinal corner edges, but has proved ineffectual in the case of packets designed for example with rounded or bevelled longitudinal corner edges, that is to say, all those styles of packets in which the tabs generated by the C-slits are unable, by reason of the particular shape selected for the packet, to interfere with the flank faces of the lid in such a way as will retain it stably and correctly in the closed position.

The object of the present invention is to provide a rigid packet with a hinged lid that is unaffected by the aforementioned drawbacks.

DISCLOSURE OF THE INVENTION

The stated object is realized according to the present invention in a rigid packet with hinged lid for tobacco products, comprising a container with an open end, and a lid hinged to the container and rotatable thus between positions in which the open end is open and closed, also a frame projecting from the open end and presenting at least two side pieces destined to engage in contact with the insides of corresponding flank faces presented by the lid when the lid occupies the closed position, characterized in that the inside of each flank face of the lid presents a freely projecting tongue, and in that each side piece of the frame presents a slit affording an opening such as will accommodate at least a portion of the corresponding freely projecting tongue.

The invention will now be described in detail, by way of example, with the aid of the accompanying drawings, in which.

Figure 1:
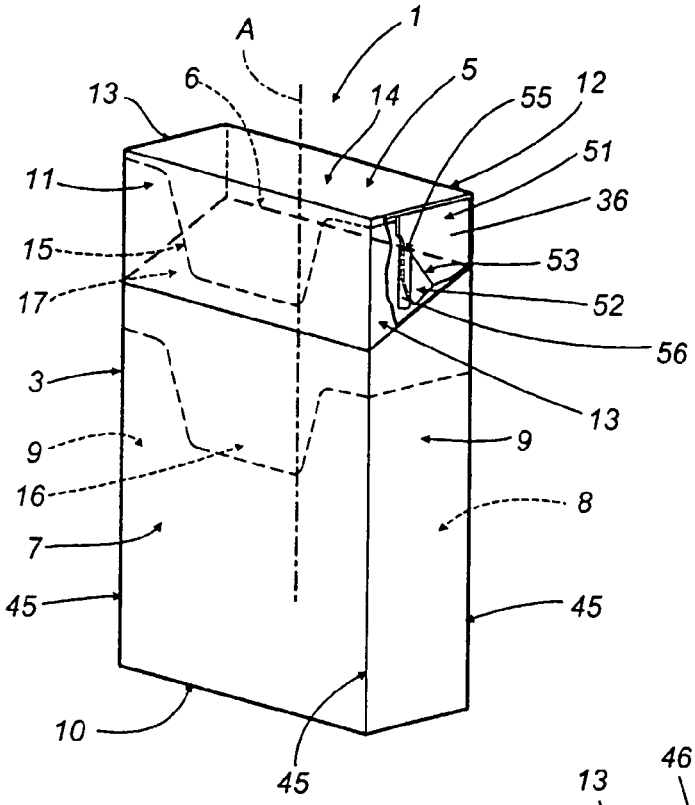
FIGS. 1 to 5 illustrate a rigid packet embodied in different styles, all according to the present invention, viewed schematically and in perspective with certain parts omitted for clarity.
Figure 2:
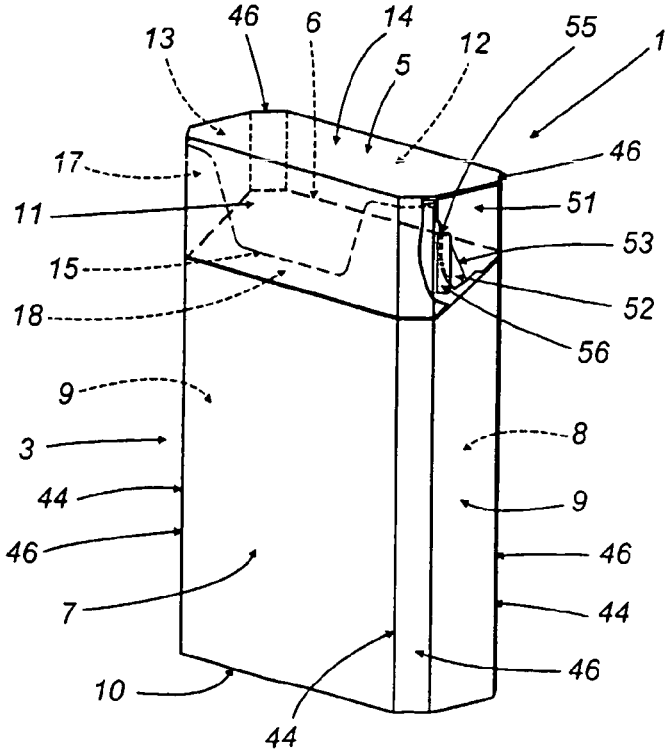
Figure 3:
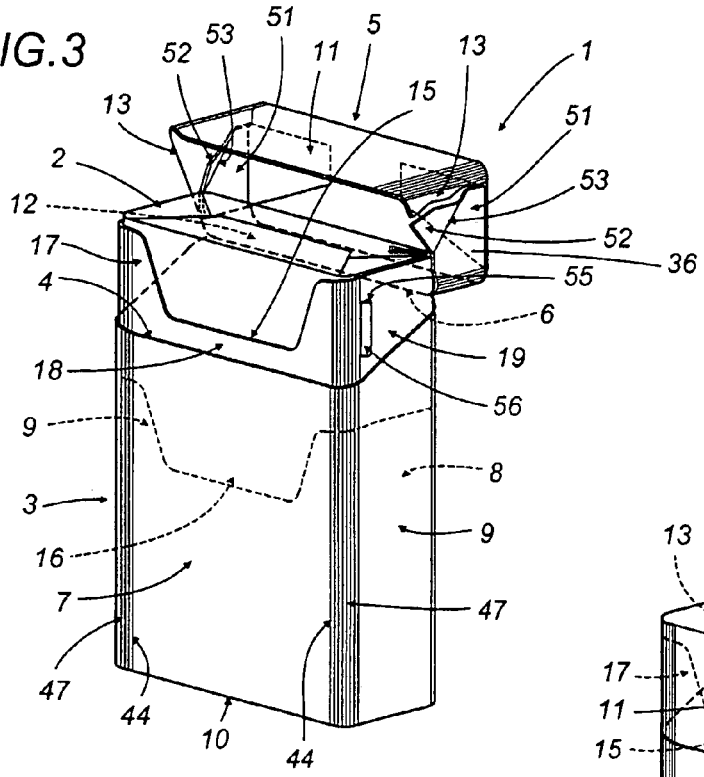

With reference to FIGS. 1, 2, 3, 4 and 5 of the drawings, 1 denotes a packet or carton for tobacco products, in its entirety, consisting for example in a rigid packet serving to accommodate a group of cigarettes (not illustrated) enveloped by an inner wrapper 2 (FIG. 3). Alternatively, the packet or carton 1 might serve to accommodate a plurality of packets of cigarettes.

The packet 1 comprises a container 3 of cupped embodiment presenting an open top end 4, and a lid 5, likewise of cupped embodiment, attached to the container 3 along a relative hinge line 6 and rotatable thus between positions in which the top end 4 is opened and closed, respectively.

The container 3 presents a front face 7, a rear face 8, two flank faces 9 and a bottom end face 10; in like manner the lid 5 presents a front face 11, a rear face 12, two flank faces 13 and a top end face 14.

The single packet 1 is furnished with a frame 15 anchored to the container 3, comprising a lower portion 16 disposed internally of the container 3 and a portion 17 that projects upward from the open top end 4 of the selfsame container.

More exactly, the frame 15 presents a breast piece 18 disposed partially in contact with the inside of the front face 7 of the container 3, and two side pieces 19 secured partially to the inside of the flank faces 9 of the container 3.

The breast piece 18 of the frame 15 is delimited uppermost by an edge of U outline, establishing a cutaway directed toward the lid 5.

Figure 4:
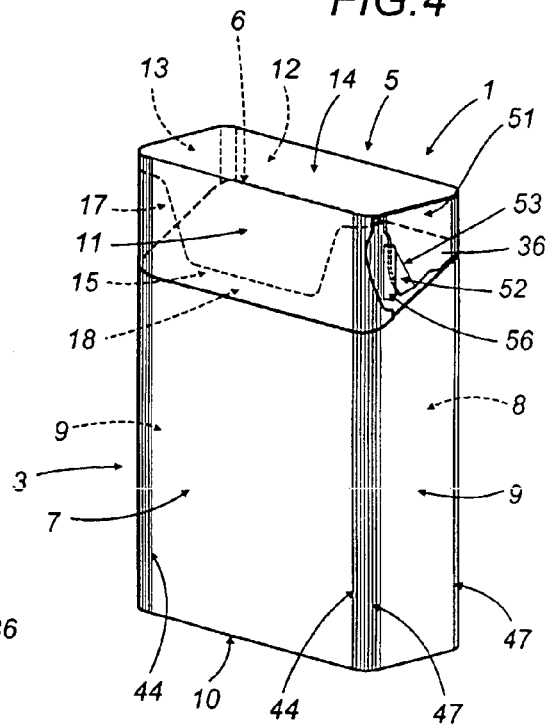
Figure 6:
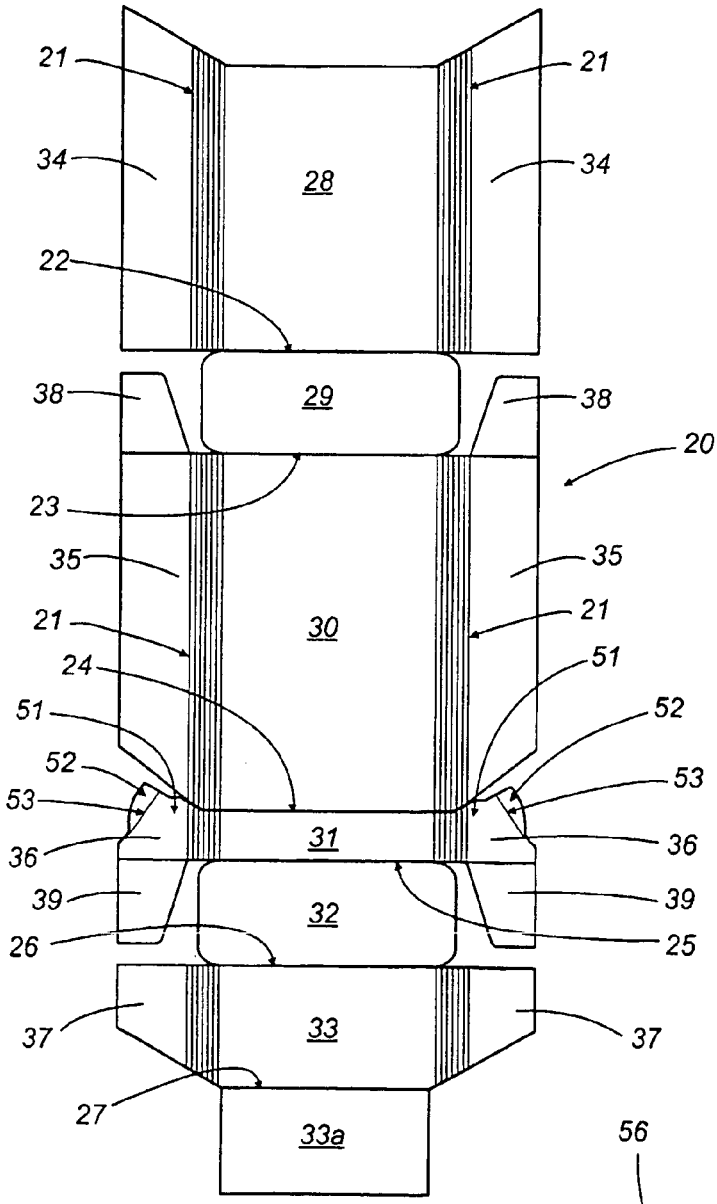
FIGS. 6 and 7 are plan views of two flat diecut blanks used to fashion the packet of FIG. 4, in particular.

Referring to FIG. 6 of the drawings, 20 denotes a flat diecut blank of substantially rectangular outline that is folded by a conventional procedure to fashion a rigid packet as illustrated, by way of example, in FIGS. 3 and 4.

The blank 20 presents two longitudinal precreased bend areas 21, and a plurality of transverse crease lines denoted 22, 23, 24, 25, 26 and 27 combining with the aforementioned longitudinal bend areas 21 to delineate a corresponding plurality of central panels denoted 28, 29, 30, 31, 32 and 33, these in turn defining the respective front faces 7 and 11, rear faces 8 and 12, and end faces 10 and 14 of the container 3 and the lid 5. The transverse crease line denoted 27 constitutes a line of separation between the endmost panel 33 and a reinforcing end fold 33*a* that will be bent double and flattened against the selfsame panel 33 to stiffen the lid 5.

The two longitudinal bend areas 21 also establish a division between the central panels 28, 30, 31 and 33 and corresponding pairs of lateral panels denoted 34, 35, 36 and 37 respectively. Lastly, the lateral panels 35 of one pair present respective flaps 38 extending toward the panels denoted 34, and the lateral panels 36 of another pair present respective flaps 39 extending toward the panels denoted 37.

The longer lateral panels 34 and 35 are designed to overlap and constitute the flank faces 9 of the container 3, whilst the shorter lateral panels 36 and 37 are designed to overlap and constitute the flank faces 13 of the lid 5. More precisely, the panels 34 of one longer pair are placed over the panels 35 of the other longer pair and the relative flaps 38 serve to join these same panels 35 to the panel 29 constituting the bottom end face 10 of the container 3; likewise, the panels 37 of one shorter pair are placed over the panels 36 of the other shorter pair and the relative flaps 39 serve to join these panels 36 to the panel 32 constituting the top end face 14 of the lid 5. Accordingly, the pair of panels denoted will be innermost on the flank faces 9 of the container 3, and the pair of panels denoted 36 will be innermost on the flank faces 13 of the lid 5.

Figure 7:
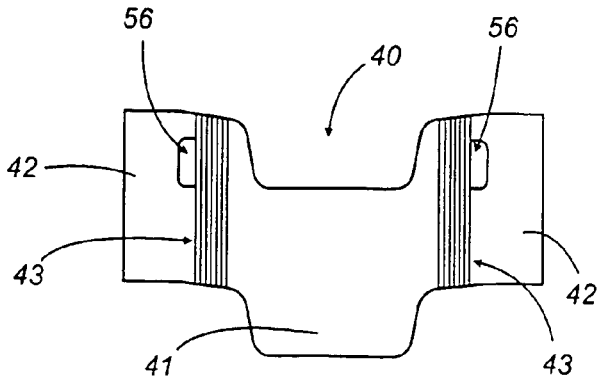

Referring to FIG. 7 of the drawings, 40 denotes a flat diecut blank from which the frame 15 of the packet 1 is folded. The blank 40 presents a central panel 41 establishing the breast piece 18 of the frame 15, and two lateral panels 42 establishing the side pieces 19. The two lateral panels 42 are joined to the central panel 41 along two respective longitudinal precreased bend areas 43.

Figure 5:
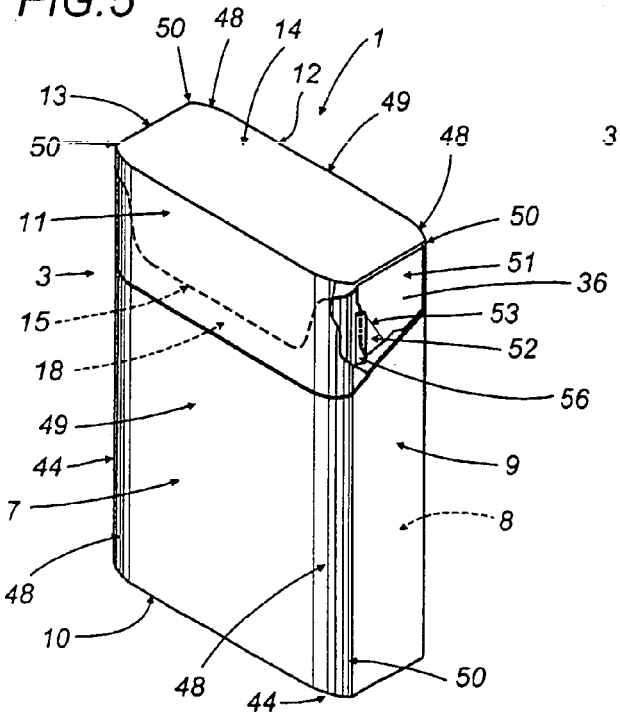

It will be seen that in the particular example of FIGS. 6 and 7, illustrating blanks 20 and 40 from which to fashion the packet of FIGS. 3 and 4, the aforementioned bend areas 21 and 43 consist in a plurality of longitudinal crease lines, whereas in the case of the packets illustrated in FIGS. 1, 2 and 5, the corresponding areas 21 and 43 of the relative blanks (not illustrated) will appear each as a single longitudinal bend line in the case of the packet 1 in FIG. 1 as a pair of longitudinal bend lines in the case of the packet 1 in FIG. 2, and as a plurality of longitudinal crease lines in the case of the packet 1 in FIG. 5.

The packets fashioned by folding the respective flat blanks are all substantially parallelepiped in appearance, presenting longitudinal corner edges denoted 44 which in the case of FIG. 1 appear as sharp edges 45, in the case of FIG. 2 as bevelled edges 46, and in the case of FIGS. 3 and 4 as rounded edges 47, whilst in the case of FIG. 5, finally, each of the longitudinal corner edges 44 appears as a band 48 of curved transverse profile, disposed with the concave face directed inwards, interconnecting a central part 49 of the front faces 7 and 11 and the rear faces 8 and 12 of the container 3 and the lid 5 with the flank faces 9 and 13 of the container 3 and the lid 5, which are joined along corresponding sharp corner edges 50.

As illustrated in FIG. 6, each of the lateral panels denoted 36 presents a larger portion 51 adjoining the relative longitudinal bend area 21 and a smaller outer portion creating a tongue 52, rendered distinct from the larger portion 51 by a crease line 53 that extends across the panel 36. When the packet 1 is erected by folding the blank, the outside face of each larger portion 51 will be breasted in contact with the inside face of the relative overlapping panel 37 whilst the relative tongue 52 remains free to rotate about the crease the lid 5, as illustrated to advantage in FIG. 8. Each of the two lateral panels 42 constituting the side pieces 19 of the frame 15 presents a slit 54 disposed substantially parallel to the longitudinal axis A of the packet and fashioned as a letter "C" in such a way as to create an opening 55 that will admit at least a portion of the corresponding tongue 52 when the lid 5 is closed.

Figure 8:
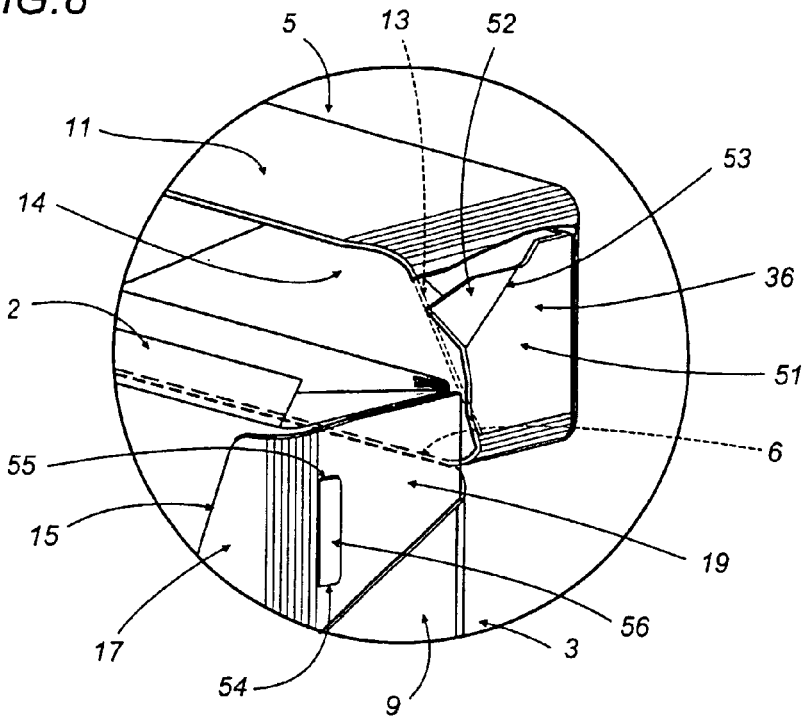
FIGS. 8 and 9 show an enlarged detail of the packet according to the present invention, seen in perspective with certain parts omitted for clarity and illustrated in two different embodiments.
Figure 9:
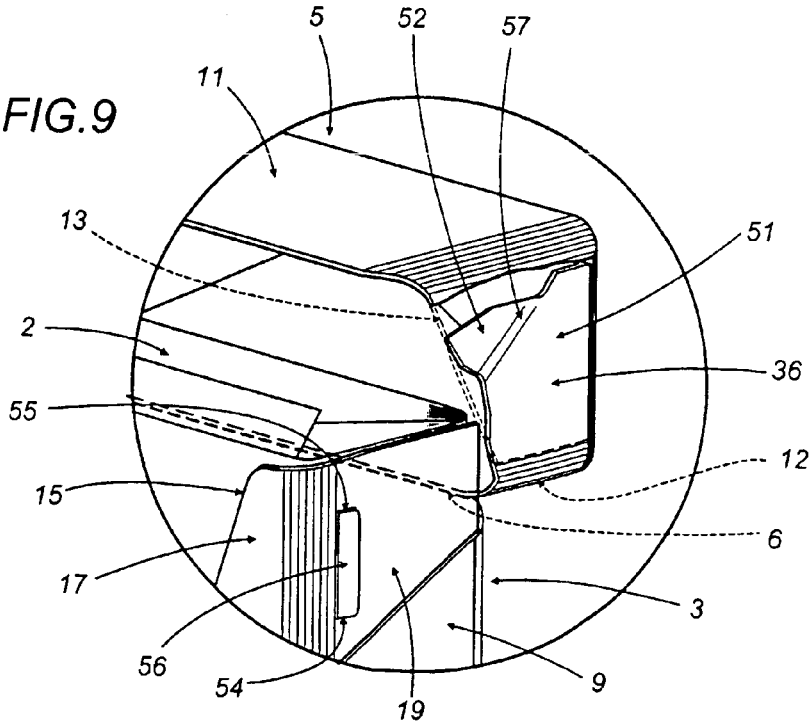
Figure 12:
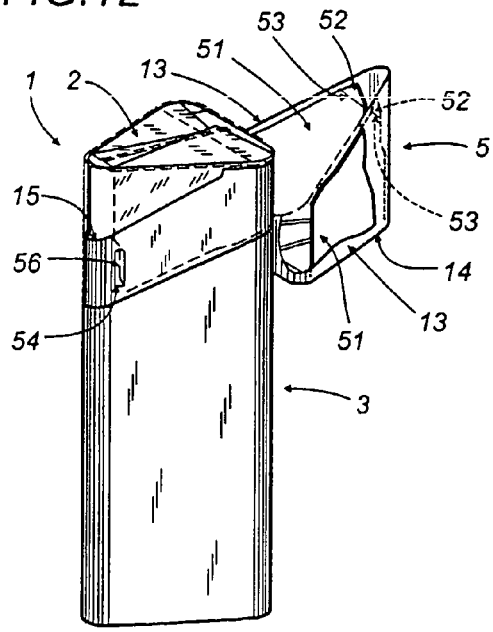
FIG. 12 illustrates a further embodiment of the packet according to the present invention, viewed schematically and in perspective with certain parts omitted for clarity.

More exactly, the slit 54 generates a tab 56 that will project outwards from the side piece 19 when the packet is formed and remain positioned thus, as discernible in FIGS. 1 to 5 and in FIGS. 8, 9 and 12, with the free edge directed toward the rear face 12 of the lid 5.

To ensure that the tongue 52 can locate without difficulty in the relative opening 55, the smaller portion of the panel 36 is shaped so as to present at least one cusp. Whenever the lid 5 is closed, moreover, the two side pieces 19 of the frame 15 will engage and remain firmly in contact with the insides of the corresponding flank faces 13 of the lid 5, with the result that the tabs 56 are forced back toward the side pieces 19 of the frame 15, serving thus as elements by which the respective tongues 52 are compressed and held in place when slotted into the relative openings 55. The effect of this compression, which will be at its greatest when the lid 5 is fully closed, is to pinch and grip the portion of the tongue 52 inserted through the opening 55 and thus retain the lid correctly in the closed position.

In the example of FIG. 9, the tongue 52 is bent toward the inside of the lid 5 along a plastically deformed area denoted 57 and made thus to occupy a plane substantially parallel to that occupied by the flank face 13.

Figure 10:
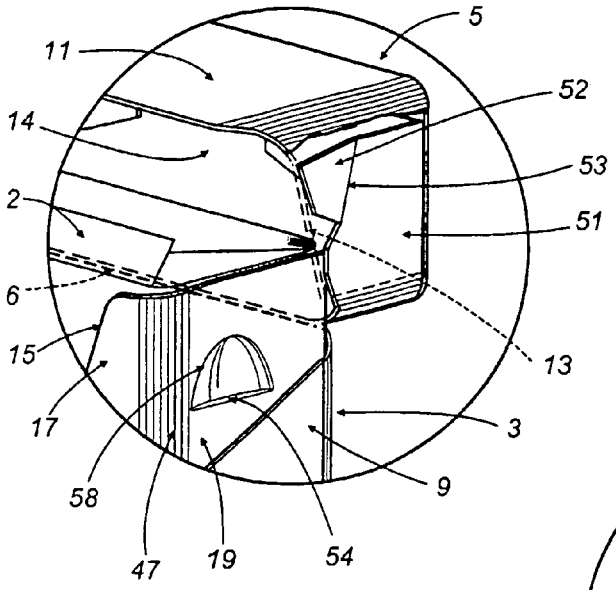
FIGS. 10 and 11 show the same enlarged detail of the packet according to the present invention as in FIGS. 8 and 9, seen in perspective with certain parts omitted for clarity and illustrated in a further embodiment.
Figure 11:
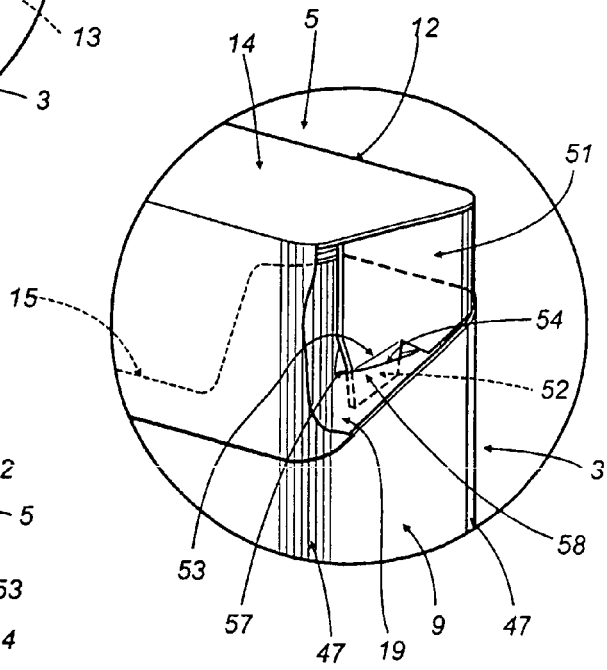

In the examples of FIGS. 10 and 11, the slit 54 extends in a direction substantially transverse to the longitudinal axis A of the packet 1 and appears essentially rectilinear. Also, each side piece 19 of the frame 15 presents a deformed portion 58 that is located adjacent to the slit 54 and shaped in such a way as will cause the edges of the selfsame slit to spread apart.

Lastly, FIG. 12 illustrates a rigid packet 1 presenting a prismatic shape of triangular section, to which the description of the tongue 52 and the slit 54 relating to the packets 1 of FIGS. 1 to 5 is similarly applicable in every respect.

The invention claimed is:

1. A rigid packet with a hinged lid, for tobacco products, comprising a container with an open end, and a lid hinged to the container and rotatable thus between positions in which the open end is open and closed, also a frame projecting from the open end and presenting at least two side pieces destined to engage in contact with the insides of corresponding flank faces presented by the lid when the lid occupies the closed position, wherein the inside of each flank face of the lid presents a freely projecting tongue, and in that each side piece of the frame presents a slit affording an opening such as will accommodate at least a portion of the corresponding freely projecting tongue; wherein the slit extends in a direction substantially parallel to the longitudinal axis of the packet and wherein the slit presents a C-shaped outline such as will generate a tab projecting outward from the frame and directed toward a rear face of the packet.

2. A packet as in claim 1, wherein the tongue is directed toward the inside of the lid.

3. A packet as in claim 1, wherein each slit combines with the inside of the flank face of the lid, when the lid is returned to the closed position, to create means by which the portion of the freely projecting tongue is compressed and retained.

4. A packet as in claims 1, wherein the freely projecting tongue coincides with the endmost portion of an internal panel presented by the flank face of the lid.

5. A packet as in claim 4, wherein the tongue is bent toward the inside of the lid along a crease line generated on the panel.

6. A packet as in claim 4, wherein the tongue is bent toward the inside of the lid along a plastically deformed area of the panel.

7. A packet as in claims 1, wherein the tongue is shaped in such a way as to present at least one cusp such as will favor the insertion of the selfsame tongue into the opening afforded by the slit.

8. A packet as in claims 1, presenting beveled longitudinal corner edges.

9. A packet as in claims 1, presenting rounded longitudinal corner edges.

10. A packet as in claims 1, wherein each of the longitudinal corner edges presents a band of curved transverse profile disposed with the concave face directed inwards, by way of which a central part of one main face of the packet is connected to an adjoining flank face along a sharp corner edge.

11. A packet as in claims 1, appearing substantially parallelepiped in shape with four longitudinal corner edges delimiting four side faces arranged in two mutually parallel pairs, and two end faces disposed mutually parallel and perpendicular to the side faces.

12. A packet as in claims 1, appearing prismatic in shape and substantially triangular in section.

13. A packet as in claims 1, fashioned from a flat diecut blank of one of cardboard or cardboard-like material.

* * * * *